US010818220B2

(12) United States Patent
Tseng et al.

(10) Patent No.: US 10,818,220 B2
(45) Date of Patent: Oct. 27, 2020

(54) DRIVING METHOD OF DISPLAY PANEL

(71) Applicant: E Ink Holdings Inc., Hsinchu (TW)

(72) Inventors: Chao-Ming Tseng, Hsinchu (TW); Yu-Hsun Kuo, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 16/141,931

(22) Filed: Sep. 25, 2018

(65) Prior Publication Data

US 2019/0130814 A1 May 2, 2019

(30) Foreign Application Priority Data

Nov. 1, 2017 (CN) ..... 2017 1 1055567

(51) Int. Cl.
*G09G 3/20* (2006.01)
*G09G 3/34* (2006.01)

(52) U.S. Cl.
CPC ..... *G09G 3/2092* (2013.01); *G09G 3/2007* (2013.01); *G09G 3/344* (2013.01); *G09G 3/348* (2013.01); *G09G 2310/027* (2013.01); *G09G 2310/0221* (2013.01); *G09G 2310/0243* (2013.01); *G09G 2310/0267* (2013.01); *G09G 2310/06* (2013.01); *G09G 2320/0233* (2013.01)

(58) Field of Classification Search
CPC ..... G09G 3/3413; G09G 2320/064; G09G 3/3607; G09G 2320/0633; G09G 3/2014; G09G 2310/06; G09G 2310/0278
See application file for complete search history.

(56) References Cited

U.S. PATENT DOCUMENTS 8,355,018 B2 1/2013 Rhodes et al.
9,024,862 B2 5/2015 Rhodes
9,190,025 B1 11/2015 Zehner et al.
9,495,918 B2 11/2016 Harrington et al.
(Continued)

FOREIGN PATENT DOCUMENTS

CN 1495697 5/2004
CN 100495172 6/2009
(Continued)

OTHER PUBLICATIONS

"Office Action of China Counterpart Application", dated Mar. 16, 2020, p. 1-p. 10.

*Primary Examiner* — Gerald Johnson
(74) *Attorney, Agent, or Firm* — JCIPRNET

(57) ABSTRACT

A driving method of a display panel is provided. The display panel includes first signal lines, second signal lines, pixel structures, first signal line driving circuits, and second signal line driving circuits. The first signal line driving circuits divide the first signal lines into first signal line groups and sequentially enable the first signal lines of the first signal line groups. In one of the first signal line groups, when one first signal line adjacent to another first signal line group is enabled, the second signal line driving circuits provide a first data signal to each of the second signal lines; and when the rest of the first signal lines are enabled, the second signal line driving circuits provide a second data signal to each of the second signal lines. The first data signal and the second data signal have different waveforms to display a predetermined gray scale.

10 Claims, 4 Drawing Sheets

(56) References Cited

U.S. PATENT DOCUMENTS

| | | | | |
|---|---|---|---|---|
| 2007/0257878 | A1* | 11/2007 | Tanaka | G09G 3/3413 345/99 |
| 2010/0265226 | A1* | 10/2010 | Yasuda | G09G 3/3666 345/206 |
| 2013/0194250 | A1 | 8/2013 | Amundson et al. | |
| 2013/0321278 | A1 | 12/2013 | Sjodin et al. | |
| 2016/0125812 | A1 | 5/2016 | Liu et al. | |
| 2016/0163287 | A1 | 6/2016 | Ahn et al. | |

FOREIGN PATENT DOCUMENTS

| | | |
|---|---|---|
| CN | 101551967 | 10/2009 |
| CN | 103187018 | 7/2013 |
| CN | 104795028 | 7/2015 |
| CN | 105261339 | 1/2016 |
| CN | 105448250 | 3/2016 |
| CN | 104240631 | 9/2016 |

* cited by examiner

DRIVING METHOD OF DISPLAY PANEL

CROSS-REFERENCE TO RELATED APPLICATION

This application claims the priority benefit of China application serial no. 201711055567.9, filed on Nov. 1, 2017. The entirety of the above-mentioned patent application is hereby incorporated by reference herein and made a part of this specification.

BACKGROUND OF THE INVENTION

1. Field of the Invention

The invention relates to a driving method. More particularly, the invention relates to a driving method of a display panel.

2. Description of Related Art

As popularity of electronic devices grows, the display technologies continue to advance, so as to satisfy requirements from increasing types of applications. Taking electronic paper display panels for example, the electronic paper display panels are able to provide a display effect similar to that of the physical paper and feature a characteristic of power saving. The electronic paper display panels are thus introduced in more and more products. The circuit design and the driving methods of the electronic paper display panels are constantly improved for reducing border sizes so as to provide larger effective display areas. Nevertheless, regardless of the methods to be adopted, the electronic paper display panels are required to provide a uniform display effect.

SUMMARY OF THE INVENTION

The invention provides a driving method of a display panel which allows the display panel to provide a uniform display effect.

In the driving method of the display panel provided by an embodiment of the invention, the display panel includes a plurality of first signal lines, a plurality of second signal lines, a plurality of pixel structures, a plurality of first signal line driving circuits, and a plurality of second signal line driving circuits. Each of the pixel structures is driven by one of the first signal lines and one of the second signal lines to display a gray scale. The driving method provided by an embodiment of the invention includes that the first signal line driving circuits divide the first signal lines into a plurality of first signal line groups and sequentially enable the first signal lines of the first signal line groups; the second signal line driving circuits provide a first data signal to each of the second signal lines when one first signal line in one of the first signal line groups adjacent to another first signal line group is enabled, and the second signal line driving circuits provide a second data signal to each of the second signal lines when the rest of the first signal lines in the same first signal line group are enabled. The first data signal has a first waveform to display a pre-determined gray scale, the second data signal has a second waveform to display the pre-determined gray scale, and the first waveform is different from the second waveform.

In an embodiment of the invention, a cycle of the first waveform is identical to a cycle of the second waveform.

In an embodiment of the invention, a pulse width of the first waveform is different from a pulse width of the second waveform.

In an embodiment of the invention, a pulse height of the first waveform is different from a pulse height of the second waveform.

In an embodiment of the invention, the first data signal provided by the second signal line driving circuits has a first adjustment waveform when the first signal line adjacent to the previous first signal line group in one of the first signal line groups is enabled; the first data signal provided by the second signal line driving circuits has a second adjustment waveform when the first signal line adjacent to the following first signal line group in the same first signal line group is enabled; and the first adjustment waveform to display the pre-determined gray scale to be displayed is different from the second waveform to display the pre-determined gray scale to be displayed.

In an embodiment of the invention, a cycle of the first adjustment waveform is identical to a cycle of the second adjustment waveform.

In an embodiment of the invention, a pulse width of the first adjustment waveform is different from a pulse width of the second adjustment waveform.

In an embodiment of the invention, a pulse height of the first adjustment waveform is different from a pulse height of the second adjustment waveform.

In an embodiment of the invention, the first signal line driving circuits connect an i-th one of the first signal lines of each of the first signal line groups and an i-th one of the first signal lines of the rest of the first signal line groups to a first signal source through identical transmission lines in different time sequences to enable the first signal lines, and i is a positive integer.

In an embodiment of the invention, a number of the transmission lines is M, i is less than or equal to M, and M is a positive integer.

In an embodiment of the invention, a number of the first signal lines is N, a number of the transmission lines is M, M is less than N, and both M and N are positive integers.

To sum up, in the driving method of the display panel provided by the embodiments of the invention, the data signals can be adjusted, display inconsistency in the display panel is therefore be improved.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
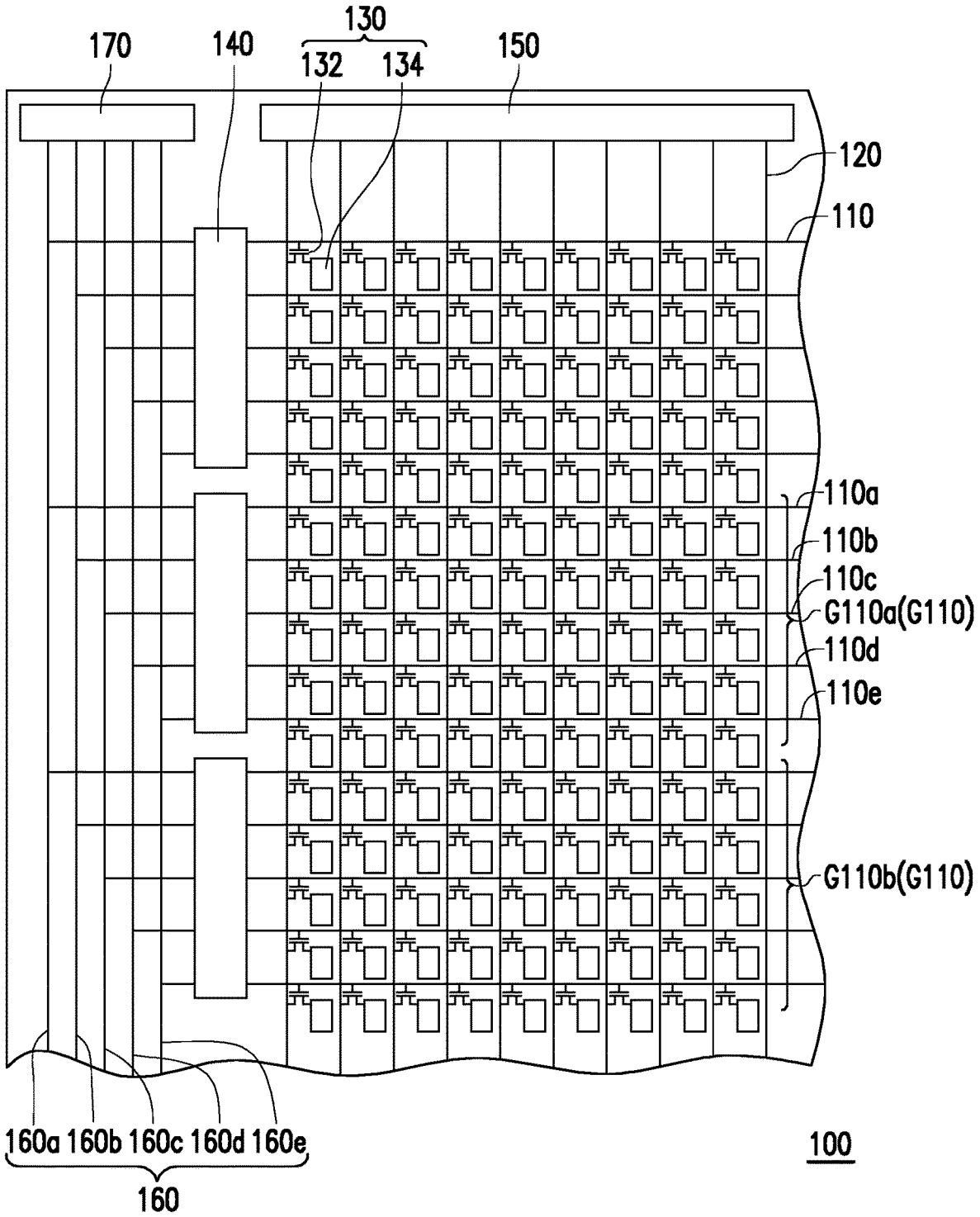
FIG. 1 is a local schematic view of a display panel according to an embodiment of the invention.

FIG. 1 is a partial schematic view of a display panel according to an embodiment of the invention. As shown in FIG. 1, a display panel 100 includes a plurality of first signal lines 110, a plurality of second signal lines 120, a plurality of pixel structures 130, first signal line driving circuits 140, and second signal line driving circuits 150. The first signal line 110 and the second signal line 120 extend in different directions and are staggered to each other. The pixel structures 130 are disposed in an array between the first signal lines 110 and the second signal lines 120 mutually intersected, and each of the pixel structures 130 is driven by one of the first signal lines 110 and one of the second signal lines 120 for displaying an image. The first signal line driving circuits 140 and the second signal line driving circuits 150 are configured to input corresponding signals to the first signal lines 110 and the second signal lines 120.

In this embodiment, each of the pixel structures 130 may include an active element 132 and a display unit 134 connected to the active element 132. The display unit 134 may include a display medium (not shown) and other components configured to control a state of the display medium (e.g., a pixel electrode, a counter electrode, a storage capacitor, etc.). In this embodiment, the display medium may be an electrophoretic display medium, an electrowetting display medium, etc. and may selectively be a substance featuring a characteristic of bistability to control the displayed light. The active element 132 may be connected to one of the first signal lines 110 and one of the second signal lines 120. The signals transmitted over the first signal lines 110 are configured to control the active elements 132 to be turned on or turned off. When the signals transmitted over the first signal lines 110 turn on the active elements 132, the first signal lines 110 may be viewed to be enabled. When the active elements 132 are turned on, the signals transmitted over the second signal lines 120 may be input to the display units 134 through the active elements 132 being turned on. At this time, the display units 134 may present a pre-determined gray scale according to the signals received so as to provide an image displaying function. Therefore, the first signal lines 110 acting as scan lines and the second signal lines 120 acting as data lines are taken as an example for explanation in this embodiment, which should however not be construed as a limitation to the invention.

The first signal line driving circuits 140 are configured to control a signal input of the first signal lines 110. For instance, the first signal line driving circuits 140 may divide the first signal lines 110 into a plurality of first signal line groups G110. The display panel 100 may further include a plurality of transmission lines 160 and a first signal source 170. The transmission lines 160 are connected between the first signal line driving circuits 140 and the first signal source 170. The first signal source 170 is configured to provide the signals to be input to the first signal lines 110, and the signals from the first signal source 170 are input to the corresponding first signal lines 110 through being transmitted by the transmission lines 160 and operated by the first signal line driving circuits 140.

In this embodiment, a number of the first signal lines 110 is N, and a number of the transmission lines 160 is M. Both N and M are positive integers, and N is greater than M. In FIG. 1, M is illustrated as 5 as an example, but in other embodiments, M can be other positive integers. As shown in FIG. 1, the first signal line driving circuits 140 may group M first signal lines 110 into one first signal line group G110. The first signal lines 110 in the same first signal line group G110 may be respectively connected to the transmission lines 160. To be specific, an i-th one of the first signal lines 110 in one first signal line group G110 may be correspondingly connected to an i-th one of the transmission lines 160, wherein i is a positive integer and is less than or equal to M. For instance, a first one of the first signal lines 110*a* is correspondingly connected to a first one of the transmission lines 160*a*, a second one of the first signal lines 110*b* is correspondingly connected to a second one of the transmission lines 160*b*, a third one of the first signal lines 110*c* is correspondingly connected to a third one of the transmission lines 160*c*, a fourth one of the first signal lines 110*d* is correspondingly connected to a fourth one of the transmission lines 160*d*, and a fifth one of the first signal lines 110*e* is correspondingly connected to a fifth one of the transmission lines 160*e*.

In this embodiment, the first signal line driving circuits 140 may control each of the first signal line groups G110 to be electrically connected to or not to be electrically connected to the transmission lines 160. For instance, the first signal line driving circuits 140 may select one of the first signal line groups G110 to be electrically connected to the transmission lines 160, while the rest of the first signal line groups G110 are allowed not to be electrically connected to the transmission lines 160. At this time, the first signal source 170 may provide the signals to the first signal line 160*a* to the fifth signal line 160*e* in sequence. As such, in the first signal line groups G110 electrically connected to the transmission lines 160, the first one of the first signal lines 110*a* to the fifth one of the first signal lines 110*e* may be sequentially enabled after sequentially receiving the signals provided by the first signal source 170.

Figure 2:
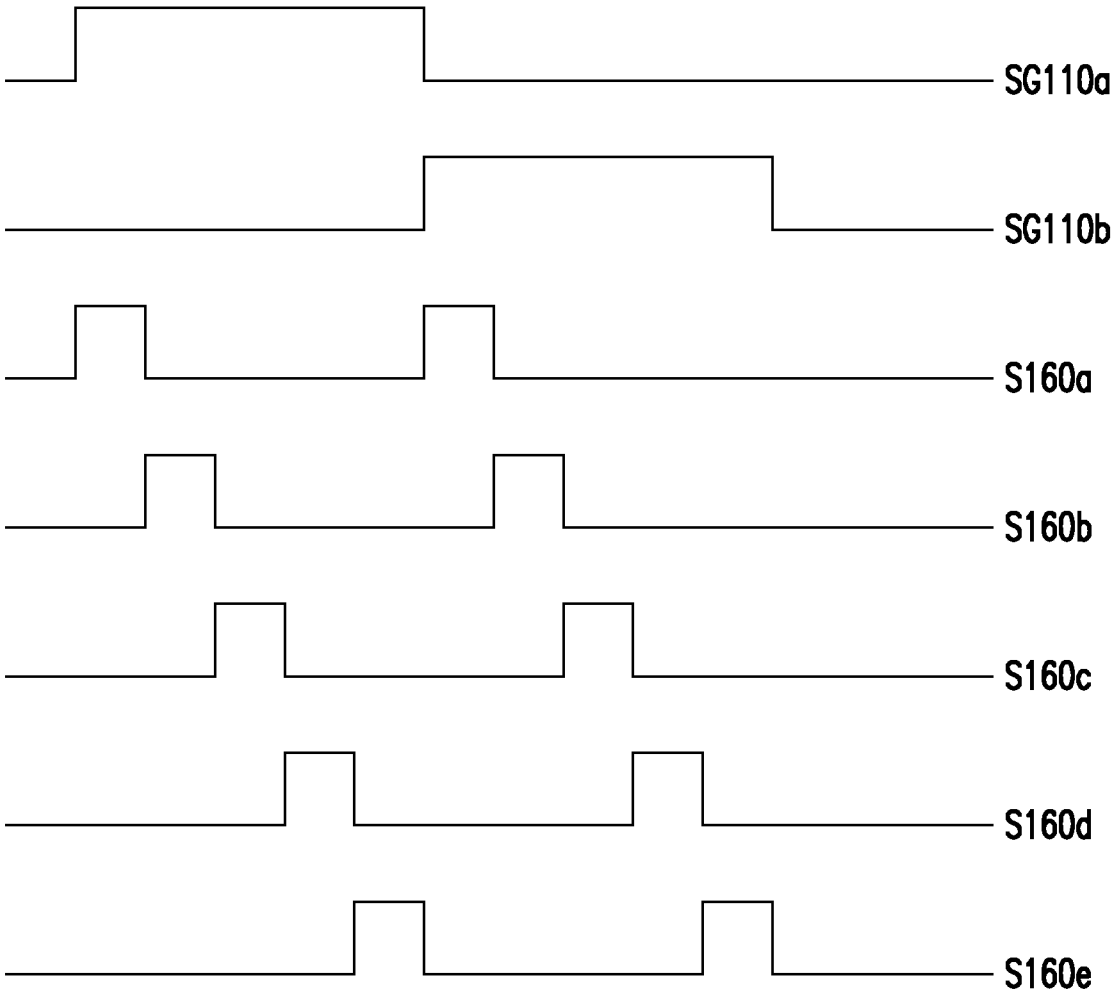
FIG. 2 is a schematic diagram of signals of a first driving circuit and a transmission line according to an embodiment of the invention.

FIG. 2 is a schematic diagram of signals of a first driving circuit and a transmission line according to an embodiment of the invention. With reference to FIG. 1 and FIG. 2 together, a signal SG110*a* and a signal SG110*b* are respectively configured to select signals of a first signal line group G110*a* and a first signal line group G110*b*. A signal S160*a* is a signal provided to the transmission line 160*a* by the first signal source 170, a signal S160*b* is a signal provided to the transmission line 160*b* by the first signal source 170, a signal S160*c* is a signal provided to the transmission line 160*c* by the first signal source 170, a signal S160*d* is a signal provided to the transmission line 160*d* by the first signal source 170, and a signal S160*e* is a signal provided to the transmission line 160*e* by the first signal source 170.

The first signal line driving circuits 140 select the first signal line group G110*a* to be connected to the transmission lines 160 according to the signal SG110*a*. At this time, the first signal line 110*a* of the first signal line group G110*a* may receive a signal transmitted by the transmission line 160*a*, the first signal line 110*b* of the first signal line group G110*a* may receive a signal transmitted by the transmission line 160*b*, the first signal line 110*c* of the first signal line group G110*a* may receive a signal transmitted by the transmission line 160*c*, the first signal line 110*d* of the first signal line group G110*a* may receive a signal transmitted by the transmission line 160*d*, and the first signal line 110*e* of the first signal line group G110*a* may receive a signal transmitted by the transmission line 160*e*. Meanwhile, since the first signal line group G110*b* is not electrically connected to the transmission lines 160, the first signal line 110*a* to the first signal line 110*e* in the first signal line group G110*b* do not receive signals.

Next, the first signal line driving circuits 140 select the first signal line group G110*b* to be connected to the transmission lines 160 according to the signal SG110*b*. At this time, the first signal line 110*a* to the first signal line 110*e* of the first signal line group G110*b* may sequentially receive the signals transmitted by the transmission line 160*a* to the transmission line 160*e*. Meanwhile, since the first signal line group G110*a* is not electrically connected to the transmission lines 160, the first signal line 110*a* to the first signal line 110*e* in the first signal line group G110*a* do not receive signals. In this way, in the display panel 100 of this embodiment, as the number of the transmission lines 160 is less than the number of the first signal lines 110, signal transmission of the first signal lines 110 are thereby achieved. Since the number of the transmission lines 160 is lowered, the display panel 110 may have a relatively narrow border width and thus can provide a relatively large display area as required.

The second signal line driving circuits 150 provide data signals to the second signal lines 120, such that, the corresponding pixel structures 130 are input by the corresponding data signals for presenting the corresponding gray scale so as to display an image. Generally, the data signals provided by the second signal line driving circuits 150 may determine the gray scale to be displayed by the pixel structures 130. Nevertheless, when all of the pixel structures 130 of the display panel 100 are written by the same data signals, in certain circumstances, it can be seen that the gray scale presented by the pixel structures 130 in a vicinity of boundaries of different first signal line groups G110 are different from that presented by the rest of the areas. Such inconsistency brings an evident display fault and leads to poor display quality of the display panel 100. The fault is even more apparent when all of the pixel structures 130 are enabled to present the same gray scale by the display panel 100. For instance, when a white image or a black image is displayed on the entire display panel 100, periodic gray lines may be presented in the image. Therefore, in the driving method of the display panel 100 provided by this embodiment, the data signals with different waveforms are adopted and are transmitted to the pixel structures 130 located in different areas for presenting the same pre-determined gray scale, so as to resolve the foregoing problem.

Figure 3:
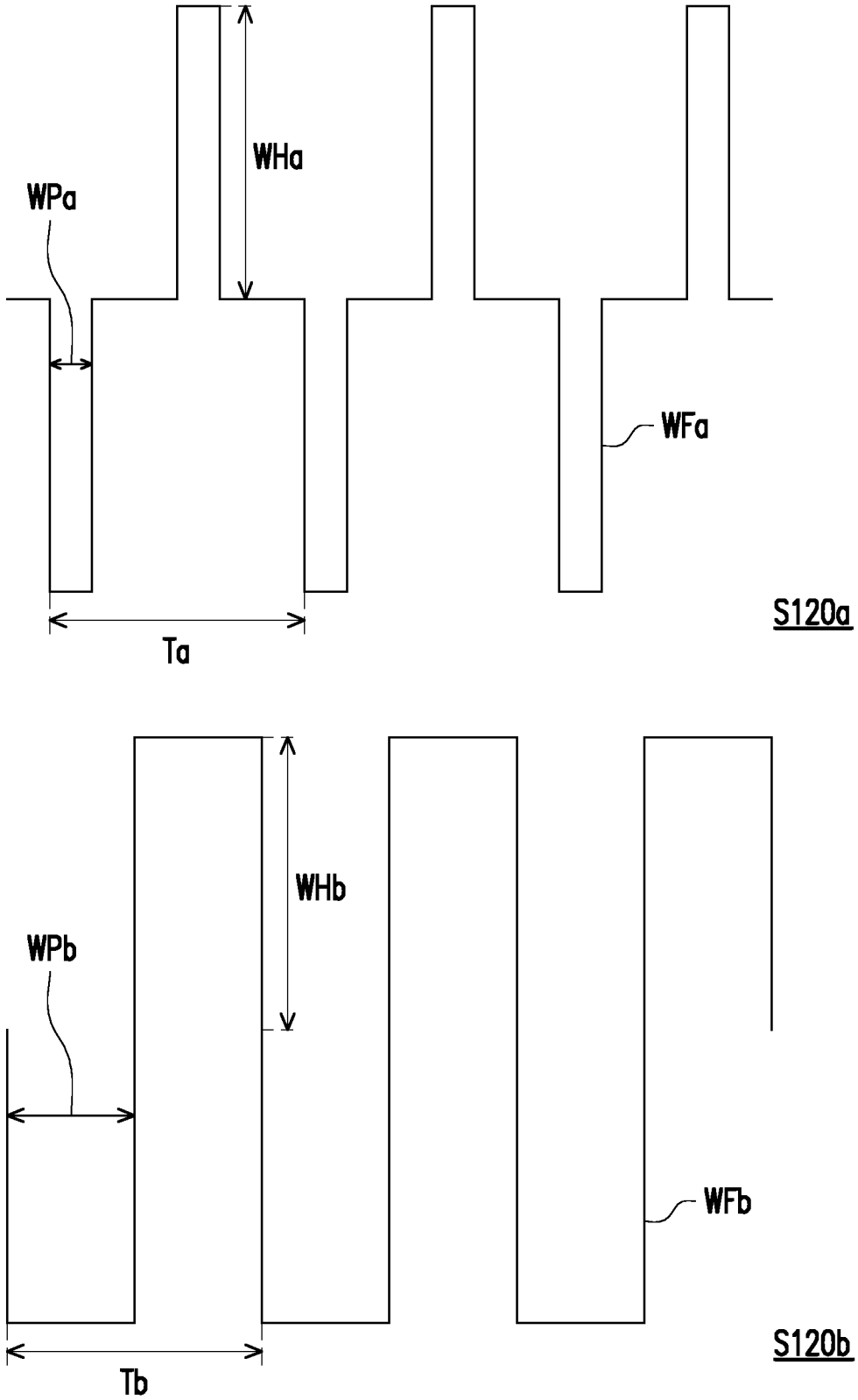
FIG. 3 are schematic diagrams of different data signals displaying an identical pre-determined gray scale in a driving method of a display panel according to an embodiment of the invention.

FIG. 3 are schematic diagrams of different data signals displaying an identical pre-determined gray scale in a driving method of a display panel according to an embodiment of the invention. With reference to FIG. 1 and FIG. 3 together, in this embodiment, the first signal line driving circuits 140 may be driven by adopting the signals of FIG. 2, such that the first signal lines 110 of the first signal line groups G110 are sequentially enabled. When one first signal line 110 (e.g., 110*a* or 110*e*) in one of the first signal line groups G110 adjacent to another first signal line group G110 is enabled, a first data signal S120*a* is provided to each of the second signal lines 120 by the second signal line driving circuits 150. When the rest of the first signal lines 110 (e.g., 110*b* to 110*d*) in the same one of the first signal line groups G110 are enabled, a second data signal S120*b* is provided to each of the second signal lines 120 by the second signal line driving circuits 150. As shown in FIG. 3, the first data signal S120*a* to display the pre-determined gray scale and the second data signal S120*b* to display the same pre-determined gray scale respectively have a first waveform WFa and a second waveform WFb. The first waveform WFa is different from the second waveform WFb.

In this embodiment, the first data signal S120*a* having the first waveform WFa is input to the respective second signal lines 120 in a time period during which the signal of the transmission line 160*a* or the transmission line 160*e* is at a high level. The second data signal S120*b* having the second waveform WFb is input to the respective second signal lines 120 in a time period during which the signals of the transmission line 160*b* to the transmission line 160*d* are at a high level. As such, the pixel structures 130 connected to the first signal line 110*a* and the first signal line 110*e* may receive the first data signal S120*a*, and the pixel structures 130 connected to the first signal line 110*b* to the first signal line 110*d* may receive the second data signal S120*b*.

As shown in FIG. 3, the first waveform WFa has a first period Ta, the second waveform WFb has a second period Tb, and the first period Ta and the second period Tb are the same. As such, although the first data signal S120*a* and the second data signal S120*b* have different waveforms, the driving method of this embodiment may be performed at a fixed image updating rate. In addition, a pulse width WPa of the first waveform WFa is different from a pulse width WPb of the second waveform WFb, wherein the pulse width WPa of the first waveform WFa is illustrated to be less than the pulse width WPb of the second waveform WFb, which should however not be construed as a limitation to the invention. The first data signal S120*a* and the second data signal S120*b* are configured to display the same pre-determined gray scale; hence, a pulse height WHa of the first waveform WFa and a pulse height WHb of the second waveform WFb may be identical to each other in this embodiment. Therefore, after being input to the corresponding pixel structures 130, even though the first waveform WFa and the second waveform WFb are different, the identical gray scale may be presented by the pixel structures 130 in a vicinity of boundaries of different first signal line groups G110 and the rest pixel structures 130. Through such a driving method, the display panel 100 is able to provide favorable displaying uniformity.

Figure 4:
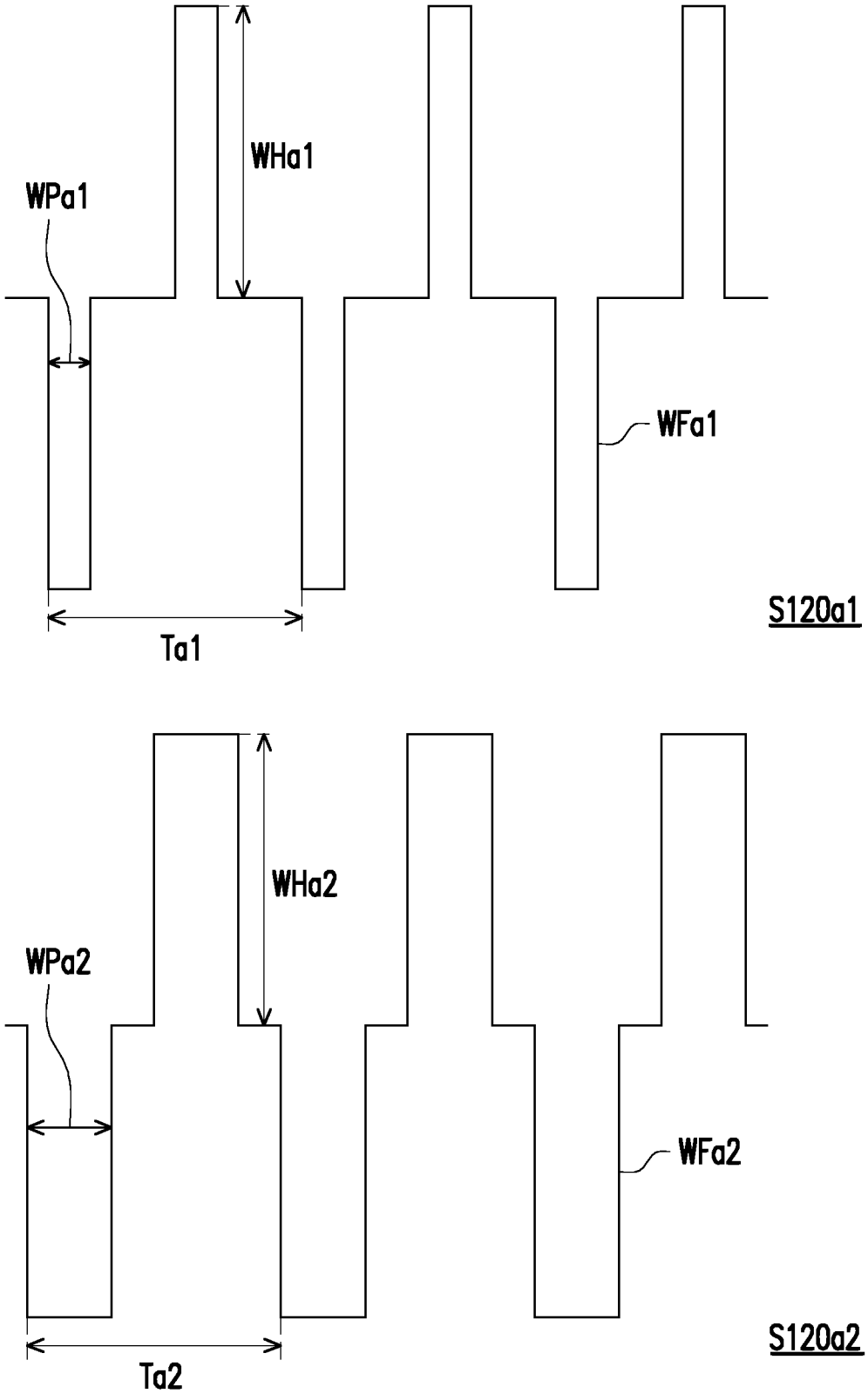
FIG. 4 schematically illustrates signals input to second signal lines to display a pre-determined gray scale when the first signal line 110*a* and the first signal line 110*e* are enabled.

In addition, in some embodiments, the data signals with different waveforms may also be adopted by the pixel structures 130 on the first signal line 110*a* and the pixel structures 130 on the first signal line 110*e*, so as to display the identical pre-determined gray scale. For instance, FIG. 4 schematically illustrates the signals input to the second signal lines to display the pre-determined gray scale when the first signal line 110*a* and the first signal line 110*e* are enabled. With reference to FIG. 4, when the first signal line 110*a* is enabled, a signal input to the second signal lines 120 to display the pre-determined gray scale may be one of a first data signal S120*a*1 and a first data signal S120*a*2. When the first signal line 110*e* is enabled, a signal input to the second signal lines 120 to display the pre-determined gray scale may be the other one of the first data signal S120*a*1 and the first data signal S120*a*2. The first data signal S120*a*1 has a first adjustment waveform WFa1, and the first data signal S120*a*2 has a second adjustment waveform WFa2. Here, both the first adjustment waveform WFa1 and the second adjustment waveform WFa2 are both different from the waveform WFb in FIG. 3. Besides, although both the first adjustment waveform WFa1 and the second adjustment waveform WFa2 are configured to allow the corresponding pixel structures 130 to display the same gray scale, the first adjustment waveform WFa1 and the second adjustment waveform WFa2 are different from each other. For instance, a pulse width WPa1 in the first adjustment waveform WFa1 is different from a pulse width WPa2 in the second adjustment waveform WFa2. Nevertheless, a period Ta1 of the first adjustment waveform WFa1 is identical to a period Ta2 of the second adjustment waveform WFa2, and a pulse height WHa1 of the first adjustment waveform WFa1 is identical to a pulse height WHa2 of the second adjustment waveform WFa2. FIG. 4 illustrates that the pulse width WPa1 is less than the pulse width WPa2 for description, but in other embodiments, the two pulse widths can be adjusted according to different requirements.

In the foregoing embodiments, differences among different waveforms may be adjusted according to the inspection and test of the display panel 100. For instance, when a full-screen of white image is displayed by one manufactured display panel 100 and a defect of gray lines appears on the white image. The waveforms of the data signals of the pixel structures located in the vicinity of the boundaries of different first signal line groups may be adjusted, so as to allow the gray scale presented to be biased towards white. When a full-screen of black image is displayed by one manufactured display panel 100 and a defect of gray lines appears on the black image. The waveforms of the data signals of the pixel structures located in the vicinity of the boundaries of different first signal line groups can be adjusted, so as to allow the gray scale presented to be biased towards black. Such signal adjustment may be repeatedly performed until the display uniformity of the display panel 100 is achieved as required. The driving method of the display panel 100 is to drive each of the pixel structures 130 by the signals adjusted through the foregoing methods. In the manufacturing process, such signals being adjusted may be directly applied to the display panel 100 manufactured in batches, and said inspection and test are thereby not required to be performed on every display panel.

In view of the foregoing, in the display panel provided by the embodiments of the invention, the waveforms of the signals input to some of the pixel structures to display the pre-determined gray scale are adjusted, such that the waveforms are different from that of the signals input to the rest of the pixel structures displaying the same gray scale. The first signal lines are enabled through being selected and divided into groups and being driven by the display panel; nevertheless, the pixel structures located in the vicinity of the boundaries of different groups may present the gray scale identical to that presented by the rest of the areas, and the uniform display effect is thereby achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A driving method of a display panel, the display panel comprising a plurality of first signal lines, a plurality of second signal lines, a plurality of pixel structures, a plurality of first signal line driving circuits, and a plurality of second signal line driving circuits, each of the pixel structures being driven by one of the first signal lines and one of the second signal lines to display a gray scale, the driving method comprising:

dividing the first signal lines into a plurality of first signal line groups by the first signal line driving circuits and sequentially enabling the first signal lines of the first signal line groups; and providing a first data signal to one of the second signal lines by the second signal line driving circuits when one first signal line in one of the first signal line groups adjacent to another of the first signal line groups is enabled, and providing a second data signal to the one of the second signal lines by the second signal line driving circuits when the rest of the first signal lines in the one of the first signal line groups are enabled, wherein the first data signal and the second data signal inputted to the one of the second signal lines respectively have a first waveform and a second waveform to display a same pre-determined gray scale, and the first waveform is different from the second waveform.

2. The driving method of the display panel as claimed in claim 1, wherein a cycle of the first waveform is identical to a cycle of the second waveform.

3. The driving method of the display panel as claimed in claim 1, wherein a pulse width of the first waveform is different from a pulse width of the second waveform.

4. The driving method of the display panel as claimed in claim 1, wherein a pulse height of the first waveform is identical to a pulse height of the second waveform.

5. The driving method of the display panel as claimed in claim 1, wherein the first data signal provided by the second signal line driving circuits has a first adjustment waveform when the first signal line in the one of the first signal line groups adjacent to a previous first signal line group is enabled, the first data signal provided by the second signal line driving circuits has a second adjustment waveform when the first signal line in the one of the first signal line groups adjacent to a next first signal line group is enabled, and the first adjustment waveform to display the pre-determined gray scale is different from the second waveform to display the pre-determined gray scale.

6. The driving method of the display panel as claimed in claim 5, wherein a cycle of the first adjustment waveform is identical to a cycle of the second adjustment waveform.

7. The driving method of the display panel as claimed in claim 5, wherein a pulse width of the first adjustment waveform is different from a pulse width of the second adjustment waveform.

8. The driving method of the display panel as claimed in claim 5, wherein a pulse height of the first adjustment waveform is identical to a pulse height of the second adjustment waveform.

9. The driving method of the display panel as claimed in claim 1, wherein the first signal line driving circuits connect an i-th first signal line of the first signal lines of each of the first signal line groups and an i-th first signal line of the first signal lines of another of the first signal line groups to a first signal source through identical transmission lines in different time sequences to enable the first signal lines, and i is a positive integer.

10. The driving method of the display panel as claimed in claim 9, wherein a number of the transmission lines is M, a number of the first signal lines is N, i is less than or equal to M, M is less than N, and both M and N are positive integers.

* * * * *